US006959825B2

(12) United States Patent
Uneme et al.

(10) Patent No.: US 6,959,825 B2
(45) Date of Patent: Nov. 1, 2005

(54) WIRING CONNECTING DEVICE BETWEEN RAILWAY VEHICLES

(75) Inventors: Tadahiko Uneme, Hyogo (JP); Akio Hasegawa, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/697,218

(22) Filed: Oct. 30, 2003

(65) Prior Publication Data

US 2004/0129664 A1 Jul. 8, 2004

(30) Foreign Application Priority Data

Oct. 31, 2002 (JP) ..... 2002-317317

(51) Int. Cl.[7] ..... B61G 5/00
(52) U.S. Cl. ..... 213/1.3
(58) Field of Search ..... 213/1.3, 1.6, 172, 213/62 R; 439/34, 35

(56) References Cited

U.S. PATENT DOCUMENTS 1,263,520 A * 4/1918 Brown ..... 213/1.3
5,216,285 A 6/1993 Hilsenteger et al.
5,558,238 A * 9/1996 Daugherty, Jr. ..... 213/50.5
5,601,030 A 2/1997 Brouillette
6,264,048 B1 7/2001 Ramnialis et al.

FOREIGN PATENT DOCUMENTS

DE 197 05 895 A1 8/1998
GB 511385 8/1939
JP 2001-264839 A1 9/2001

OTHER PUBLICATIONS

European Search Report corresponding to co-pending European Patent Application Serial No. EP 030 24 318.2 , Feb. 2004.

* cited by examiner

*Primary Examiner*—Mark T. Le
(74) *Attorney, Agent, or Firm*—Marshall, Gerstein & Borun LLP

(57) ABSTRACT

A wiring connecting box is supported by a link bar coupling a front railway vehicle and a rear railway vehicle. Receptacles connected to end portion connectors of wiring cables of the front vehicle and the rear vehicle are respectively arranged on the front face and the rear face of the wiring connecting box. A connecting cable for connecting the receptacle on the front face and the receptacle on the rear face is arranged within the wiring connecting box. The wiring cables of the front vehicle and the rear vehicle are connected to each other through the connecting cable. Smooth wiring can be performed between the vehicles by using the wiring connecting box.

3 Claims, 9 Drawing Sheets

WIRING CONNECTING DEVICE BETWEEN RAILWAY VEHICLES

BACKGROUND OF THE INVENTION

1. Field of the Invention

This invention relates to a wiring connecting device between railway vehicles in which wiring cables of front and rear vehicles are connected between the vehicles.

2. Description of the Related Art

When a train is composed, it is necessary to mutually connect many electric circuits and air circuits to each of the composed vehicles so as to control the operations of a power device and a brake device of each vehicle by generalizing and controlling acceleration and braking in a operator's seat of the lead vehicle.

Wiring cables for connecting such electric circuits of the respective vehicles to each other are arranged along the vehicle longitudinal direction below the floor face in each vehicle. It is general that these wiring cables are connected by so-called jumper cables flexed downward between the front and rear vehicles so that the electric circuits between the vehicles are connected.

In such a connecting device using the jumper cables, when no wiring cables of the front and rear vehicles are set to the corresponding position, no jumper cables for connecting these wiring cables can be connected as they are. Therefore, it is necessary to cross and connect the jumper cables between the vehicles.

However, when the jumper cables are crossed and connected between the vehicles in this way and the number of wiring cables of the front and rear vehicles is increased, the situation that the jumper cables interfere with each other within a narrow space between the vehicles and cannot be properly connected is caused. In particular, the jumper cable is flexed downward in consideration of the running of a curved railroad. Accordingly, when the number of jumper cables is increased, it is difficult to cross the jumper cables.

It is also considered that the wiring below the floor of the vehicle is devised in advance without crossing the jumper cables between the vehicles. However, there is also a case in which no wiring is devised in this way. Namely, the case that only two kinds of vehicles constructed by a first vehicle including an cab and a second vehicle including no cab are used and are coupled by using a permanent coupler called a link bar and are desirously utilized as a train of four or five vehicles, corresponds to this case.

Concretely, for example, as shown in FIG. 6A with respect to the train of four vehicles, a vehicle 101 (see FIG. 6B) with an cab 101*a* is arranged in each of front and rear both end portions of the train. Two vehicles 102 (see FIG. 6C) without cab are arranged between these vehicles 101. In this case, the positions of the wiring cables are reversely located leftward and rightward with respect to two vehicles 101, 102 on the front and two vehicles 102, 101 on the rear side. Therefore, no wiring cables can be directly connected as they are. Accordingly, it is necessary to cross the jumper cables connecting the wiring cables between the vehicles. Therefore, when the number of wiring cables necessary to be connected is increased, the jumper cables would interfere with each other so that no jumper cables can be properly connected as mentioned above.

JP2000-71984-A (see page 1 and FIG. 1) discloses an electric coupler for a railway vehicle of a type in which the electric coupler is fixed to an intermediate coupler with a mechanical buffer so as to be moved in the longitudinal direction. Concretely, one adapter case is arranged instead of the assembly of two normal electric couplers to entirely form the electric coupler simply and lightly in weight. Combination cables are crossed and wired leftward and rightward within this adapter case so as to be combined on the correct sides of the connecting cables and in a correct function with respect to the railway vehicle coupling the combination cables thereto. The connecting cables of both the railway vehicles are combined with each other through a plug and socket connection (assembly) or fixing cables each having at least one plug and socket connection (assembly).

SUMMARY OF THE INVENTION

The structure described in the above patent literature does not use the permanent coupler, but uses a central buffer coupling, a sleeve joint, a longitudinal guide, etc. Accordingly, this structure cannot be applied as it is with respect to the train composition using the permanent coupler.

An object of this invention is to provide a wiring connecting device between vehicles able to perform smooth wiring between the vehicles by using a wiring connecting box when the link bar (permanent coupler) is used in the coupling between the vehicles.

The present invention resides in a wiring connecting device for smoothly laying wiring cables between coupled railway vehicles and comprising:

a front railway vehicle;

a rear railway vehicle to be coupled to "a front railway vehicle";

a wiring connecting box supported by this link bar;

a receptacle on the front face in which an end portion connector of the wiring cable in the front railway vehicle is connected to the front face of this wiring connecting box;

a receptacle on the rear face in which an end portion connector of the wiring cable in the rear railway vehicle is connected to the rear face of said wiring connecting box; and a connecting cable to connect the back of receptacle on the front face and the receptacle on the rear face within said wiring connecting box.

In accordance with such assembly, the end portion connector of the wiring cable of the front railway vehicle is coupled to the corresponding receptacle on the front face of the wiring connecting box. The end portion connector of the wiring cable of the rear railway vehicle is coupled to the corresponding receptacle on the rear face of the wiring connecting box. Thus, the wiring cable of the front railway vehicle and the wiring cable of the rear railway vehicle are connected to each other through the wiring connecting box (connecting cable). Accordingly, smooth wiring can be performed between the railway vehicles, and it is possible to avoid the situation that the wiring cables interfere with each other and cannot be connected properly even when the number of wiring cables (e.g., about five wiring cables) is increased.

Namely, when the jumper cables are crossed and connected as in the conventional case and the number of wiring cables to be mutually connected is large, these wiring cables interfere with each other and cannot be connected properly. Accordingly, the connecting cables are laid out properly and are wired in advance within the wiring connecting box so that such disadvantages can be dissolved. Namely, the wiring cables can be properly connected by preparing the wiring connecting box corresponding to the layout of the wiring cables of each railway vehicle even when the number of wiring cables is increased.

In particular, the front and rear railway vehicles are coupled to each other by the link bar (so-called permanent coupler) and no coupling between the railway vehicles is normally released. Accordingly, the wiring connecting box can be stably supported by utilizing this link bar, and no support of the wiring connecting box becomes complicated. Further, since the wiring connecting box is arranged by effectively utilizing a dead space formed on the lower or upper side of the link bar, the wiring connecting box can be properly arranged between the railway vehicles.

The above wiring connecting box is divided into two rooms by a partition plate. The above connecting cable is desirably divided into a connecting cable located in one room of the partition plate and a connecting cable located in the other room. Here, the two rooms partitioned by the partition plate may be arranged vertically, or leftward and rightward.

In accordance with such assembly, the interior of the wiring connecting box is divided into the two rooms, and the connecting cables can be divided and wired in two groups. Accordingly, it is possible to set an advantageous assembly for avoiding the interference of the connecting cables and classifying and storing the connecting cables. Further, for example, the respective rooms can be set to rooms for low and high voltages so that a high voltage wire and a low voltage wire can be stored within the same box.

In this case, the wiring connecting box is desirably fabricated so as to have a box main body and two access covers arranged in this box main body and blocking the above two rooms so as to be opened.

In accordance with such assembly, since the two access covers are arranged such that the two rooms are respectively blocked so as to be opened with respect to the box main body, a large number of wirings can be easily performed by detaching the access covers. In particular, since one access cover is arranged with respect to each room, only one room can be opened by opening one access cover.

Further, it is possible to set assembly in which the connecting cables cross each other within the wiring connecting box and supporting members for supporting the connecting cables are arranged before and after this crossing portion.

In accordance with such assembly, the respective connecting cables are supported by the supporting members within the wiring connecting box before and after the connecting cables cross. Accordingly, the connecting cables are properly wired within the wiring connecting box.

DETAILED DESCRIPTION OF THE PREFERRED EMBODIMENTS

The embodiment modes of this invention will next be explained along the drawings.

Figure 1:
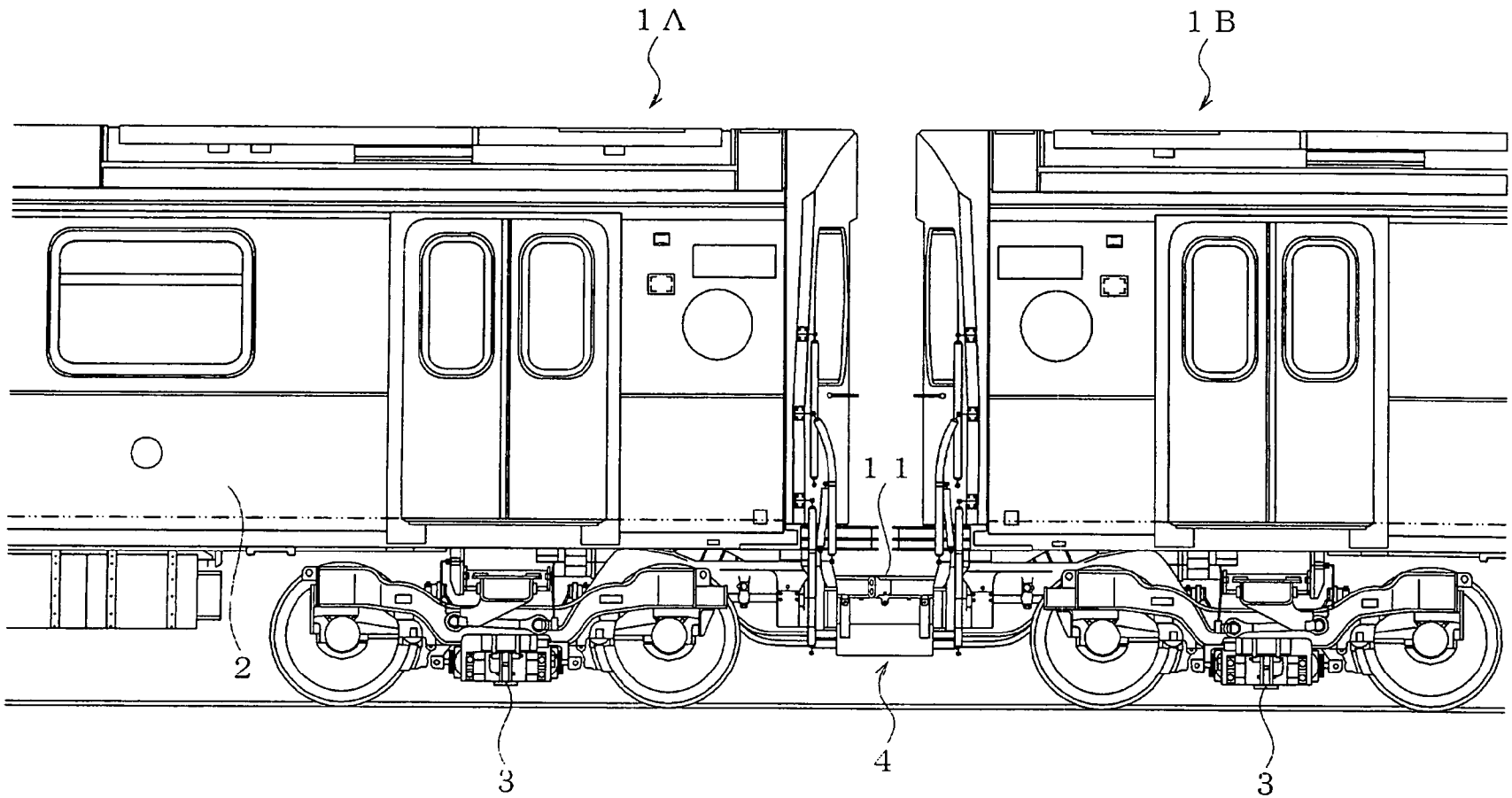
FIG. 1 is a partial side view showing a end portion of a railway vehicle to which a wiring connecting device between railway vehicles in the present invention is applied.
Figure 2:
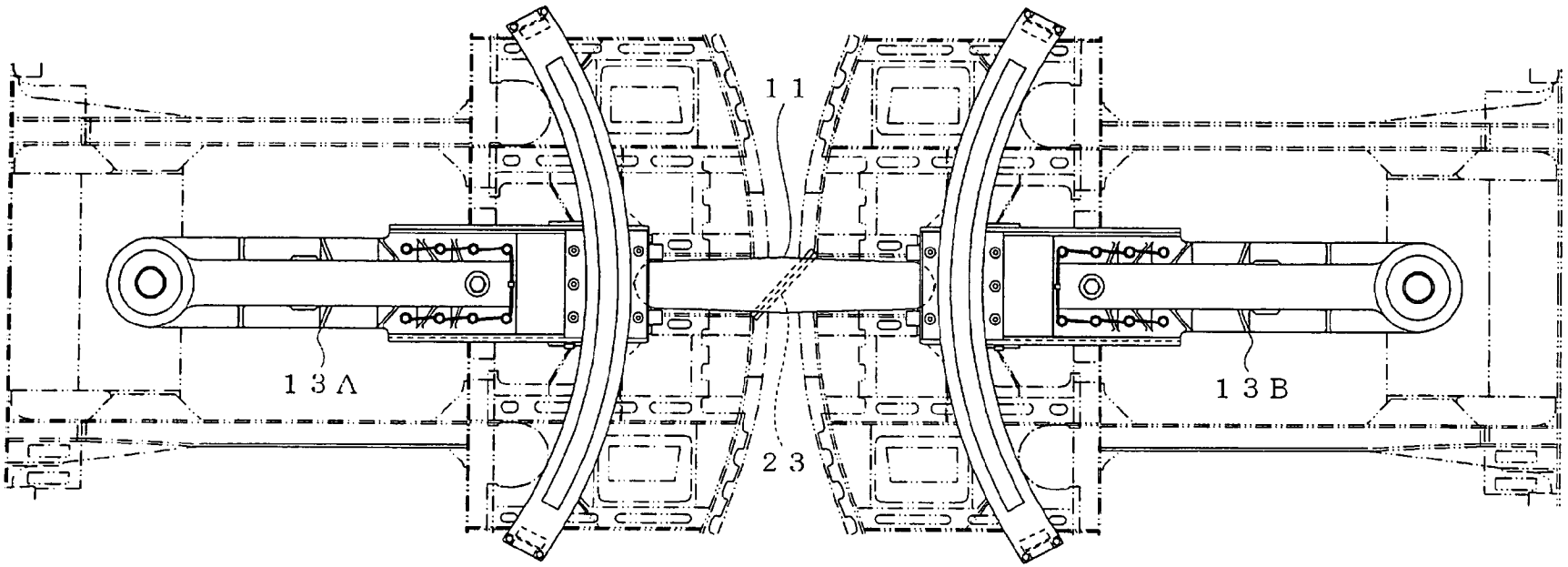
FIG. 2 is a plan view showing the vicinity of a coupling portion of the above railway vehicle.
Figure 3:
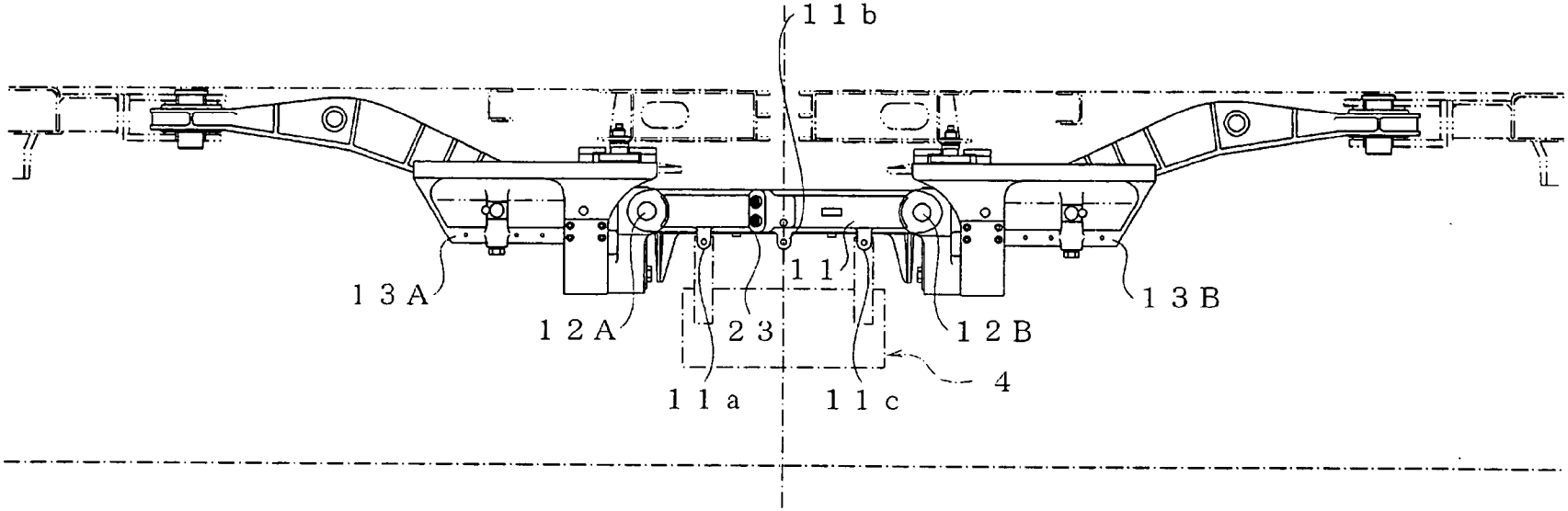
FIG. 3 is a side view showing the vicinity of the coupling portion.

FIG. 1 is a side view showing a main portion of a railway vehicle end portion to which the wiring connecting device between railway vehicles in the present invention is applied. FIG. 2 is a plan view showing the vicinity of a link bar of the above railway vehicle. FIG. 3 is a side view showing the vicinity of the link bar.

As shown in FIG. 1, in each of railway vehicles 1A, 1B constituting the composition of a train, a vehicle body 2 is supported by a bogie 3 from the lower side. The front vehicle 1A and the rear vehicle 1B are coupled to each other by this link bar 11 as a permanent coupler. A wiring connecting box 4 is arranged beneath the link bar 11 as a permanent coupler between the rear end portion of the front vehicle 1A and the front end portion of the rear vehicle 1B.

Figure 5A:
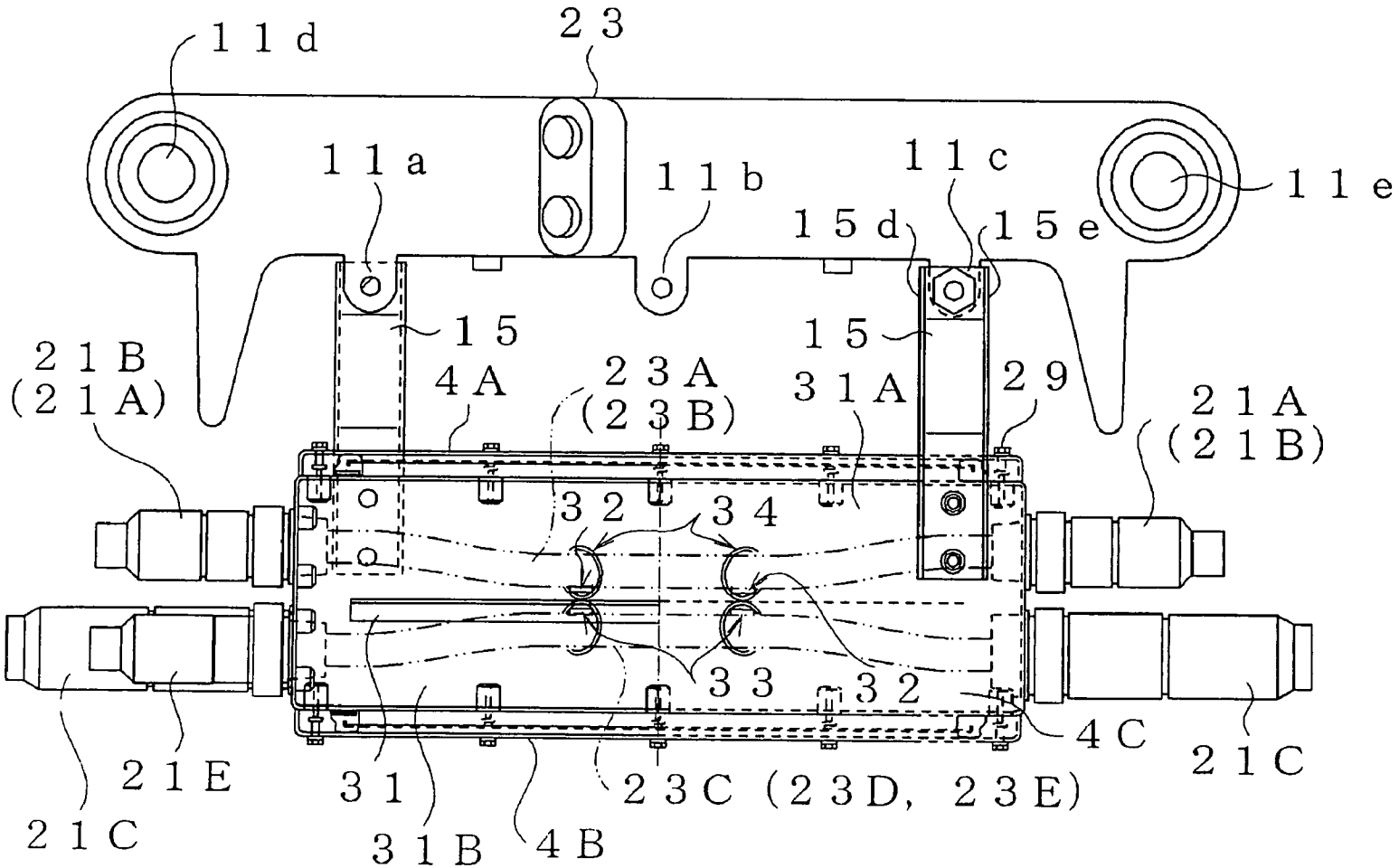
FIGS. 5A, 5B, 5C and 5D are respectively a side view, a plan view, a left side view and a right side view of the wiring connecting box.
Figure 5B:
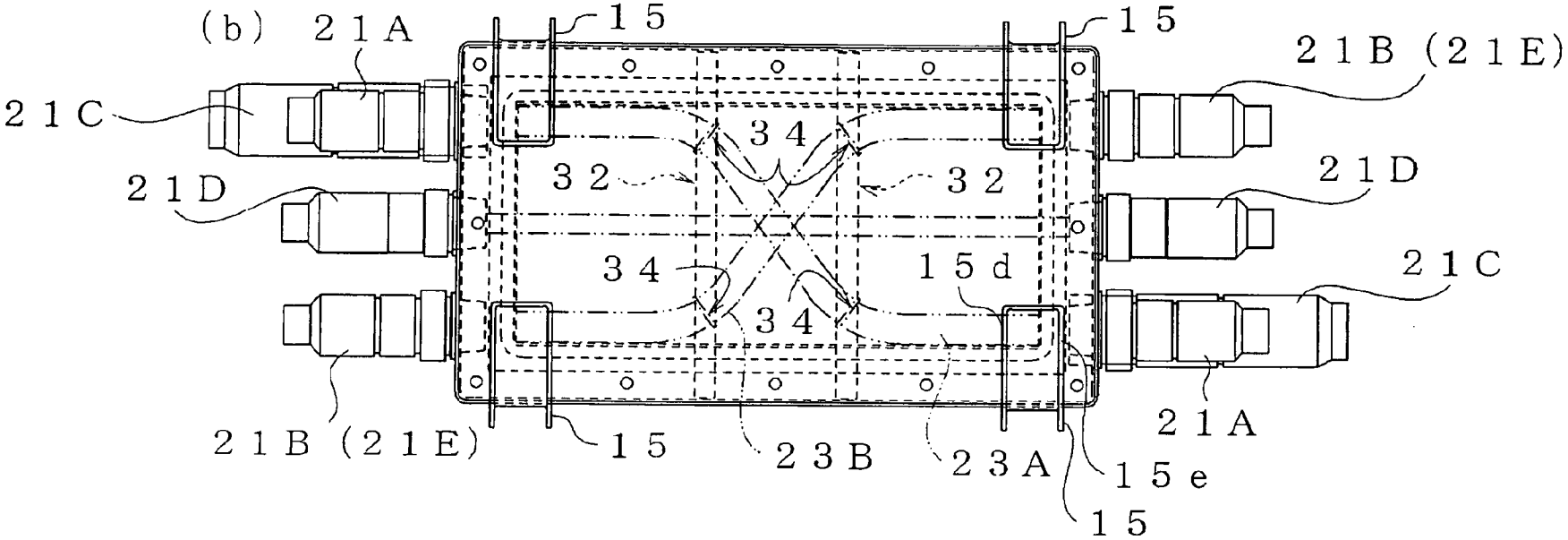
Figure 5C:
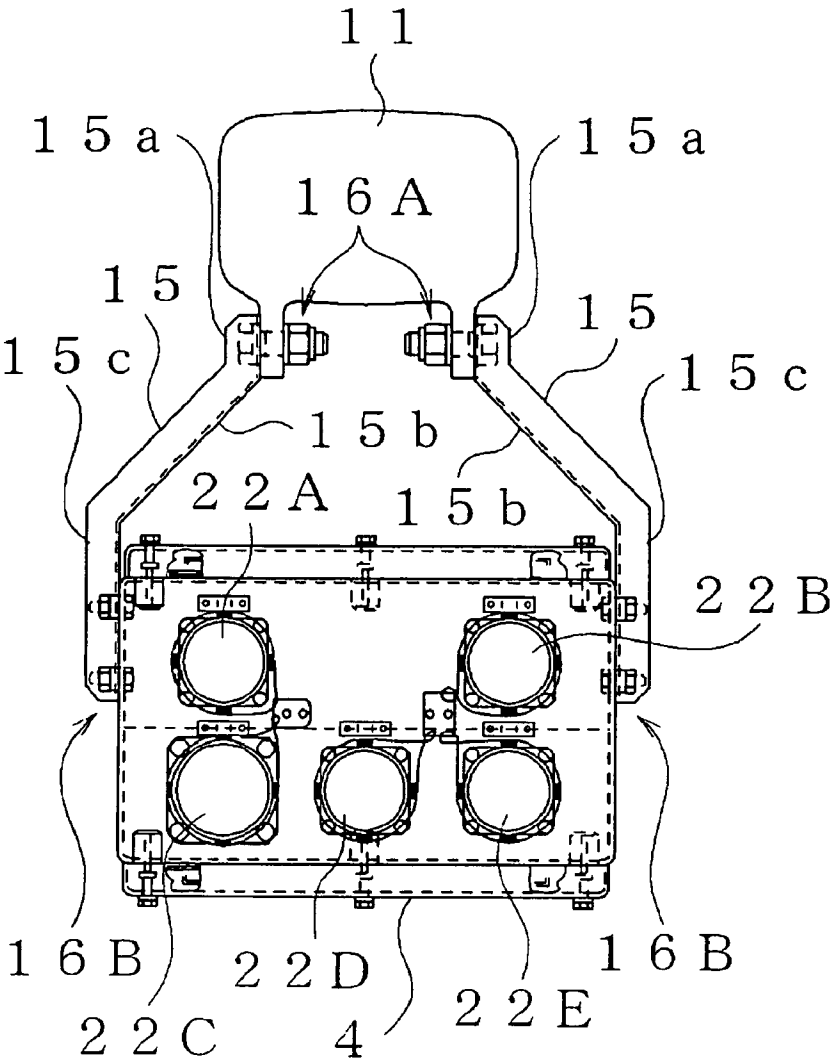
Figure 5D:
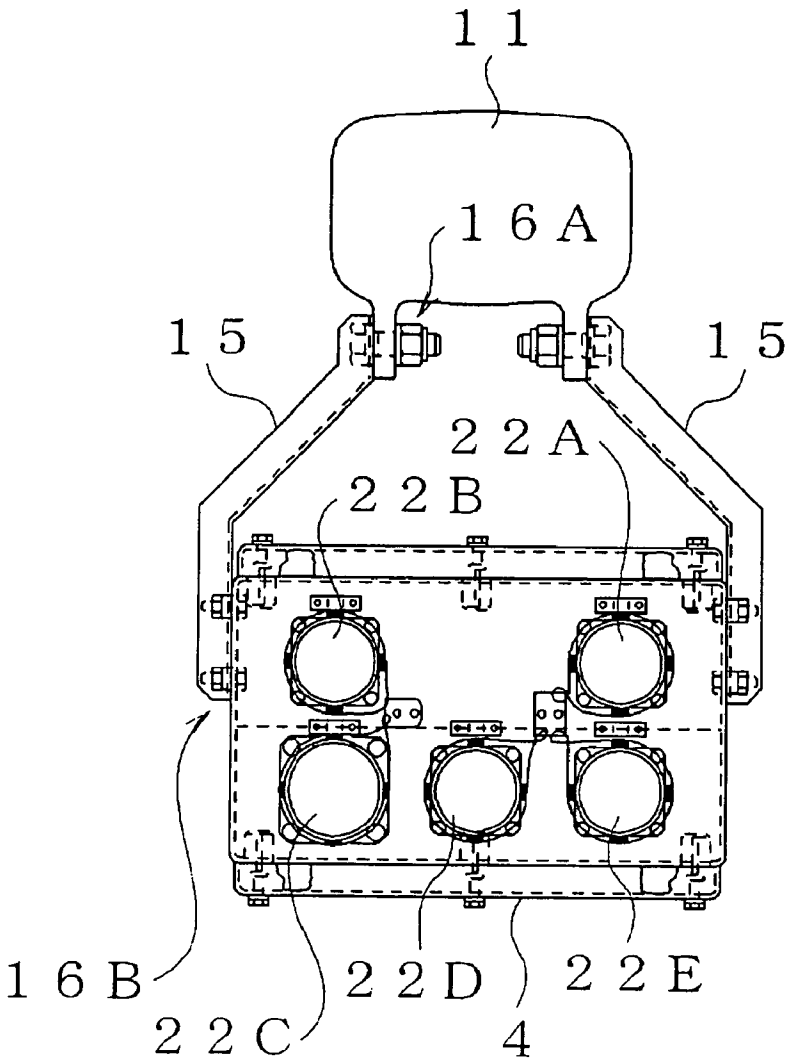
Figure 6A:
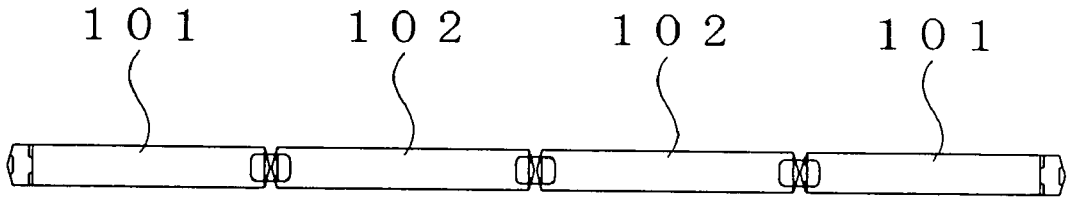
FIG. 6A is a plan view of a train composition using a permanent coupler.
Figure 6B:
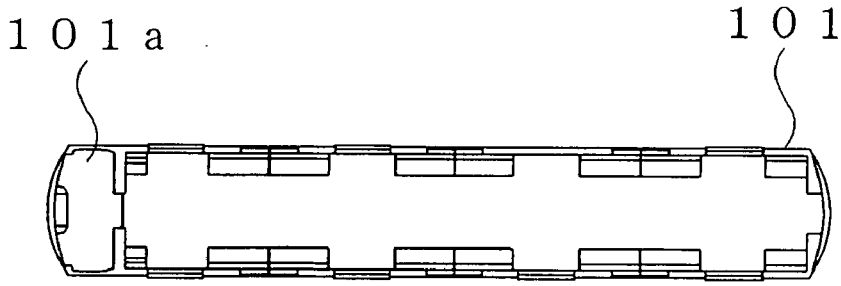
FIG. 6B is a plan view of a first railway vehicle having an cab.
Figure 6C:
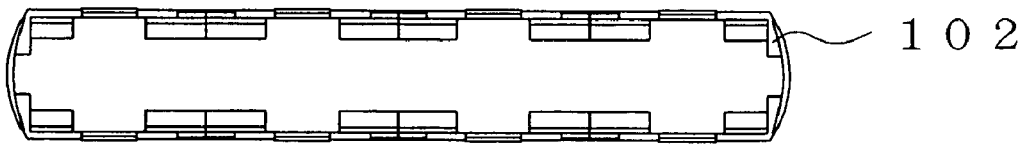
FIG. 6C is a plan view of a second railway vehicle having no cab.

As shown in FIGS. 2 and 3, in a state in which the front vehicle 1A and the rear vehicle 1B are coupled to each other by the link bar 11, the front and rear end portions of the link bar 11 are rotatably coupled to buffers (draft gears) 13A, 13B of the front vehicle by horizontal coupling pin shafts 12A, 12B in the vertical direction. Attaching holes 11*d*, 11*e* for attachment to the buffers (draft gears) 13A, 13B are formed in both end portions of the link bar 11 (see FIG. 5A).

Figure 4:
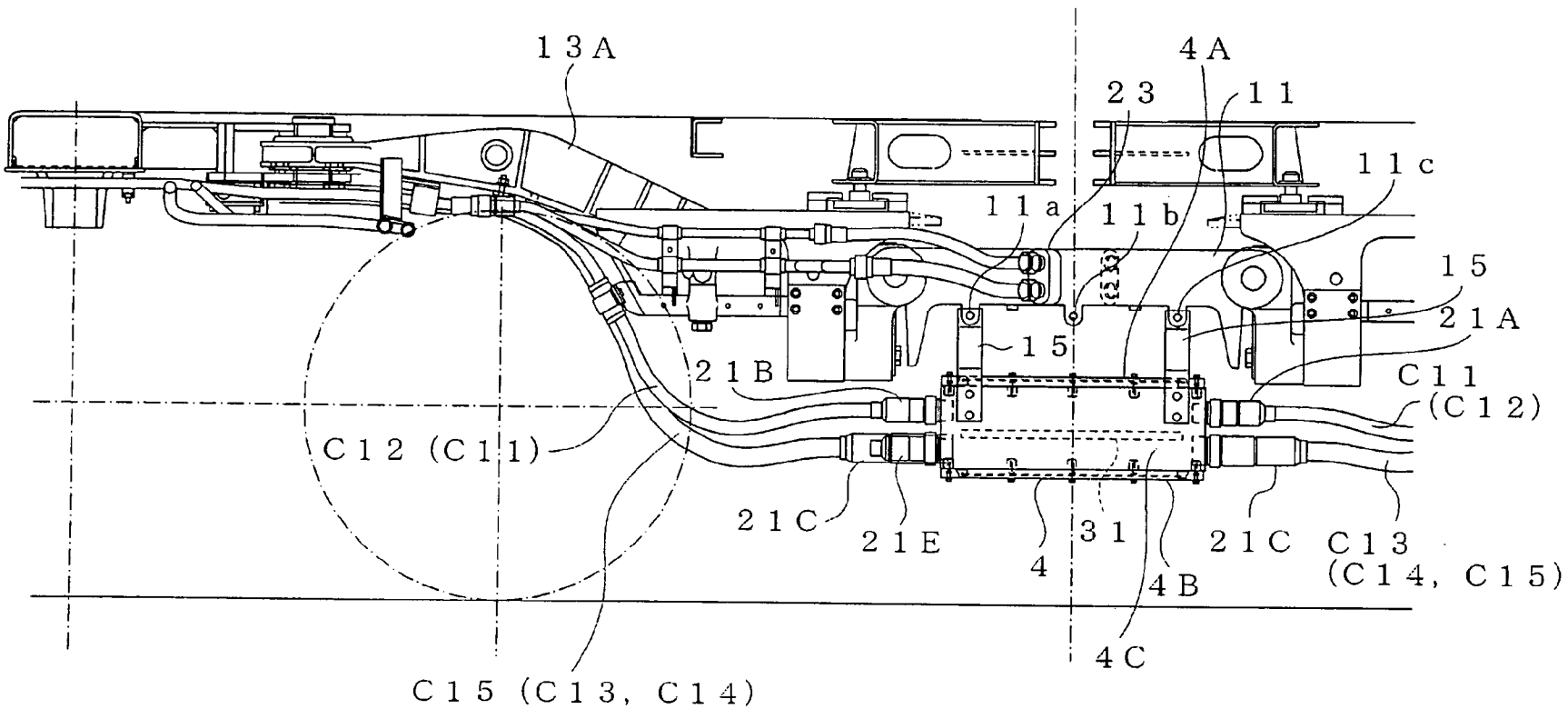
FIG. 4 is a side view showing a state in which a wiring connecting box is attached in the vicinity of the coupling portion of the above railway vehicle.

Three sets of attaching portions 11*a*, 11*b*, 11*c* (six attaching portions in total on the left and right sides) respectively projected downward are integrally formed leftward and rightward in the lower portion of the link bar 11. As shown in FIG. 4, the wiring connecting box 4 wider than the link bar 11 is attached to the remaining two attaching portions 11*a*, 11*c* except for the centrally located attaching portions among these three sets of attaching portions 11*a*, 11*b*, 11*c* through attaching brackets 15 in each of four portions constructed by front and rear and left and right portions.

Each attaching bracket 15 has an upper side attaching portion 15*a* extending in the vertical direction and attached to each of the attaching portions 11*a*, 11*c* of the link bar 11, an intermediate inclination portion 15*b* extending slantingly downward from the lower end of this upper side attaching portion 15*a* toward the exterior, and a lower side attaching portion 15*c* extending vertically downward from the lower end of this intermediate inclination portion 15*b* and attached to the side face of the wiring connecting box 4. Longitudinal wall portions 15*d*, 15*e* are arranged at both side edges of each of the portions 15*a* to 15*c* so that each of the portions 15*a* to 15*c* is formed in a U-shape in horizontal section. The upper side attaching portion 15*a* and the lower side attaching portion 15*c* of each attaching bracket 15 are fastened and fixed to the attaching portions 11*a*, 11*c* of the link bar 11 and the side face of the wiring connecting box 4 by using fastening tools 16A, 16B constructed by a bolt and a nut, etc. A connector 23 for mutually coupling air pipings of the front and rear vehicles is slantingly arranged in the vehicle forward and backward directions in an intermediate portion of the link bar 11 in its longitudinal direction.

As shown in FIGS. 4 and 5A to 5D, five receptacles 22A to 22E on the front face are arranged on the front face of this wiring connecting box 4, and end portion connectors 21A to 21E of wiring cables C11 to C15 from the front vehicle are coupled to these five receptacles 22A to 22E. Five receptacles 22A to 22E on the rear face are arranged on the rear face of the wiring connecting box 4, and end portion connectors 21A to 21E of wiring cables C11 to C15 from the rear vehicle are coupled to these five receptacles 22A to 22E.

Here, the same receptacles 22A to 22E are arranged on the front face and the rear face in the same array toward the wiring connecting box 4.

The respective receptacles 22A to 22E on the front face are electrically connected to the corresponding receptacles 22A to 22E on the rear face through connecting cables 23A to 23E arranged within the wiring connecting box 4. The front and rear wiring cables C11 to C15 connected to the respective receptacles 22A to 22E on the front face and the rear face are flexed downward so as not to affect the running of a curved railroad.

The five receptacles 22A to 22E on each of the front face and the rear face respectively correspond to the end portion connectors 21A to 21E of the wiring cables C11 to C15. The respective end portion connectors 21A to 21E are constructed so as not to be coupled to receptacles except for the corresponding receptacles 22A to 22E.

A partition plate 31 is arranged within the wiring connecting box 4 so that its internal space is vertically partitioned and is divided into two rooms constructed by an upper side room 31A and a lower side room 31B. Connecting cables 23A, 23B for low voltage mutually connecting two receptacles 22A, 22B located on the upper sides of the front face and the rear face are arranged in the upper side room 31A. These connecting cables 23A, 23B cross each other within this room 31A, and are fixed to an upper side supporting member 32 by a fixing member 34 (e.g., tie lap).

Connecting cables 23C, 23D, 23E for high voltage mutually connecting three receptacles 22C, 22D, 22E located on the lower sides of the front face and the rear face are arranged in the lower side room 31B. Receptacles 22C, 22E on both the left and right sides are connected by connecting cables 23C, 23E crossing within the room 31B. The central receptacle 22D is connected by a linear connecting cable 23D within the wiring connecting box 4. Each of the connecting cables 23C to 23E is constructed so as to be supported by a lower side supporting member 33 by means of the fixing member 34 (e.g., tie lap) before and after the crossing portion within the room 31B so that these connecting cables can properly cross each other. These wiring cables C11 to C15 are constructed by a cable for control, a cable for ground connection, a power cable, etc.

In the wiring connecting box 4, two access covers 4A, 4B are detachably attached to the upper and lower portions of a box main body 4C by plural screws 29. Thus, the wirings of the connecting cables 23A to 23E into the box 4 can be vertically separated from each other so as to easily make its wiring work. An unillustrated rubber packing is arranged between the two access covers 4A, 4B and the box main body 4C so that a waterproof structure is formed. Accordingly, waterproof performance is secured and each of the rooms 31A, 31B can be opened by detaching the access covers 4A, 4B.

Thus, the two vertical rooms 31A, 31B are formed by arranging the partition plate 31 within the wiring connecting box 4, and the crossing portions of the connecting cables 23A to 23E are formed one by one every each of the rooms 31A, 31B. In addition to this, the respective connecting cables 23A to 23E are supported by the supporting members 32, 33 before and after the crossing portions of the connecting cables 23A to 23E. Accordingly, the connecting cables 23A to 23E within the wiring connecting box 4 can be properly wired in a stable supporting state. Namely, in this invention, no wiring connecting box 4 is simply used, but the natural stable support wiring of the connecting cables 23A to 23E within the wiring connecting box 4 is realized by utilizing the partition plate 31, the supporting members 32, 33 and the fixing member 34.

If the wiring connecting box 4 is arranged between vehicles as mentioned above, the wiring cables C11 to C15 of the front and rear vehicles can be connected between the vehicles by connecting the end portion connectors 21A to 21E of the wiring cables C11 to C15 to the predetermined receptacles 22A to 22E of the wiring connecting box 4 even when the front and rear wiring cables C11 to C15 have no corresponding position relation. In this case, the jumper cables conventionally crossed each other. Instead of this, in the present invention, the connecting cables 23A to 23E cross each other within the wiring connecting box 4. Thus, thick cables and many electric wire cables can be connected between any connectors by utilizing the wiring connecting box 4.

Since the wiring connecting box 4 is attached to the link bar 11 as the permanent coupler, the wiring connecting box 4 can be arranged by securing required supporting rigidity. Since the link bar 11 is particularly the permanent coupler, no link bar 11 is normally released so that the wiring connecting box 4 is properly attached. Even if the coupling using the link bar 11 is released, it is normal that the coupling of one end portion of the link bar 11 is released and the coupling of the end portion connector of the wiring cable on this one portion side and the receptacle on the front face side (or the end portion connector on the rear face side) is released, and the coupling of the other end portion and the coupling of the end portion connector and the receptacle are maintained. Accordingly, the attaching state of the wiring connecting box 4 to the link bar 11 can be maintained. Accordingly, it is normally not necessary to consider that the wiring connecting box 4 is detached from the link bar 11.

In addition to the above description, the wiring connecting device between vehicles in the present invention can be also constructed as follows:

(1) In the above embodiment mode, the wiring connecting box 4 is attached to the link bar 11 through the four attaching brackets 15. However, if the required supporting rigidity can be secured, the number of attaching brackets may be set to an arbitrary number. Further, the wiring connecting box 4 may be also directly attached to the link bar without using the attaching bracket. Further, it is also possible to use a assembly in which an attaching portion projected upward is arranged in the upper portion of the wiring connecting box and is attached to the link bar.

(2) In the above embodiment mode, one partition plate 31 is arranged within the wiring connecting box 4, but the number of partition plates is not limited to one. For example, plural partition plates may be also arranged, and no partition plate may be also arranged. Further, the supporting members 32, 33 and the fixing member 34 may not be arranged to support the connecting cables 23A to 23E.

(3) In the above embodiment mode, the number of cables inserted into the wiring connecting box 4 is set to five, but is not limited to five. This cable number may be also set to four or less, or six or more.

What is claimed is:

1. A wiring connecting device for smoothly laying a wiring cable between coupled railway vehicles and comprising:

a front railway vehicle;

a rear railway vehicle to be coupled to the front vehicle;

a unitary link bar as a permanent coupler, a front end portion of the link bar being coupled to the front railway vehicle by a horizontal shaft and a rear end portion of the link bar being coupled to the rear railway vehicle by a horizontal shaft;

a unitary wiring connecting box supported by the link bar, wherein the wiring connecting box is divided into two rooms by a partition plate, and said connecting cable is divided into a connecting cable located in one room and a connecting cable located in the other room;

a receptacle on the front face in which an end portion connector of the wiring cable in the front vehicle is connected to the front face of this wiring connecting box;

a receptacle on the rear face in which an end portion connector of the wiring cable in the rear vehicle is connected to the rear face of said wiring connecting box; and a connecting cable for connecting the receptacle on the front face and the receptacle on the rear face within said wiring connecting box;

wherein the wiring cables of the front vehicle and the rear vehicle are connected to each other through the connecting cable.

2. The wiring connecting device between railway vehicles according to claim 1, wherein the wiring connecting box has a box main body and two access covers arranged in this box main body and blocking said two rooms so as to be respectively opened.

3. The wiring connecting device between railway vehicles according to claim 1, wherein said connecting cables cross each other within the wiring connecting box, and supporting members for supporting the connecting cable are arranged before and after this crossing portion.

* * * * *